US005885056A

United States Patent [19]

Goodwin

[11] Patent Number: 5,885,056

[45] Date of Patent: Mar. 23, 1999

[54] GAS TURBINE ENGINE CASING CONSTRUCTION

[75] Inventor: Jeremy P Goodwin, Derby, England

[73] Assignee: Rolls-Royce plc, London, England

[21] Appl. No.: 811,720

[22] Filed: Mar. 6, 1997

[51] Int. Cl.[6] ..... F01D 21/00

[52] U.S. Cl. ..... 415/9; 415/200

[58] Field of Search ..... 415/9, 200

[56] References Cited

U.S. PATENT DOCUMENTS

| | | | |
|---|---|---|---|
| 4,534,698 | 8/1985 | Tomich | 415/9 |
| 4,547,122 | 10/1985 | Leech . | |
| 4,818,176 | 4/1989 | Huether et al. | 415/9 |
| 5,336,044 | 8/1994 | Forrester . | |
| 5,447,411 | 9/1995 | Curley et al. . | |
| 5,516,258 | 5/1996 | Newton | 415/9 |

FOREIGN PATENT DOCUMENTS

| | | |
|---|---|---|
| 626 502 | 11/1994 | European Pat. Off. . |
| 0286815A1 | 10/1998 | European Pat. Off. . |
| 868197 | 5/1961 | United Kingdom . |
| 1 453 873 | 10/1976 | United Kingdom . |
| 2 159 886 | 12/1985 | United Kingdom . |

*Primary Examiner*—Christopher Verdier
*Attorney, Agent, or Firm*—W. Warren Taltavull

[57] ABSTRACT

Casing assembly for a gas turbine engine comprising an annular cross section casing around which a plurality of layers of flexible material are wound. One or more rigid panels are positioned between the wound flexible material and the annular casing. The rigid panel provides enhanced containment of a detached fan blade or part of a fan blade by distributing the load of the detached blade across the wound flexible material.

5 Claims, 2 Drawing Sheets

GAS TURBINE ENGINE CASING CONSTRUCTION

FIELD OF THE INVENTION

This invention relates to gas turbine fan duct casings and more particularly to an improved containment ring for use within or forming a part of the fan duct casing.

BACKGROUND OF THE INVENTION

Ducted fan gas turbine engines for powering aircraft conventionally comprise a core engine which drives a propulsive fan. The fan in turn, comprises a number of radially extending aerofoil blades mounted on a common hub and enclosed within a generally cylindrical casing.

There is a remote possibility with such engines that part or all of a fan blade could become detached from the remainder of the fan. This may occur as the result of, for example, the engine ingestion of a bird or other foreign body. It is, therefore, extremely important that the blade is retained within the casing and does not pass through and cause damage to the engine.

The use of containment rings for gas turbine engine casings is well known. Such rings have previously been manufactured from metal or alternatively glass fibre or carbon fibre, etc. They have normally formed an integral part of the compressor casing.

More recently the problem of fan containment has been addressed by winding strong fibrous material around a relatively thin fan casing. In the event that a fan casing becomes detached, it passes through the casing and is contained by the fibrous material.

The problem associated with such fibre wrap is that there is a danger that a blade could in certain circumstance cut though the fibre wrap and thereby pass straight through. This problem is addressed by GB 2159886B by the provision of fibrous patches positioned between the layers of material. The patches wrap around the blade during its passage through some of the material thus effectively blunting its leading edge and impeding it's progress through the remaining layers.

An additional difficulty with fan casing constructions is that in the interest of lightness the fan casing is made as thin as possible which leads to a lack of stiffness in the casing as a whole. This problem is particularly severe in large diameter fan casings. EP 0626 502 A1 discloses continuous lengths of material wound around rails which are mounted on the outer surface of the fan casing. The space between the rails is filled with discrete pieces of flexible material. Therefore, a detached blade initially breaks through the thin alloy casing, becomes 'blunted' by the discrete pieces which become attached thereto and is then retained by the material wound around the rails.

However retaining the blade within the fibrous wrap can in some circumstances be difficult to achieve.

SUMMARY OF THE INVENTION

It is therefore an aim of the present invention to alleviate the aforementioned problems and to provide improved fan blade containment apparatus.

According to the present invention there is provided a gas turbine casing assembly comprising an annular cross-section casing configured to surround an annular array of rotary aerofoil blades, said casing defining a radially outer surface and positioned therewith a plurality of layers of flexible material wound as continuous lengths around said casing characterised in that at least one substantially rigid panel is interposed between said flexible material and said annular cross-section casing.

Advantageously the rigid panel serves to distribute the load of the detached blade, along the length of the carbon panel. This helps prevent the detached blade form cutting through the wound Kevlar and enables a the number of layers of flexible material to be reduced. Additionally the provision of the rigid panel also provides additional support in the event that the casing should develop a circumferential crack. In such circumstances the rigid panel would act as a secondary load path for the aerodynamic and inertia forces within the engine mountings.

Preferably the rigid panel is moulded from carbon fibre or steel.

Additionally the rigid panel may preferably comprise a frangible material.

BRIEF DESCRIPTION OF THE DRAWINGS

The present invention will now be described by way of example, with reference to the accompanying drawings in which.

DETAILED DESCRIPTION OF THE INVENTION

Figure 1:
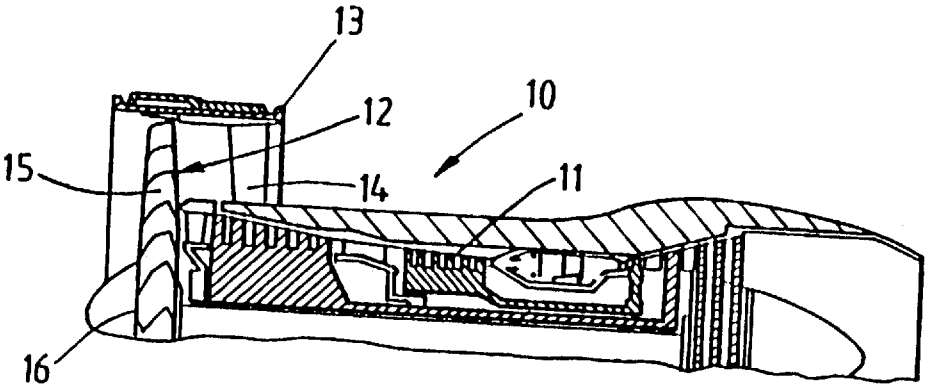
FIG. 1 is a schematic sectioned side view of the upper half of a ducted gas turbine engine having a casing in accordance with the present invention.
Figure 2:
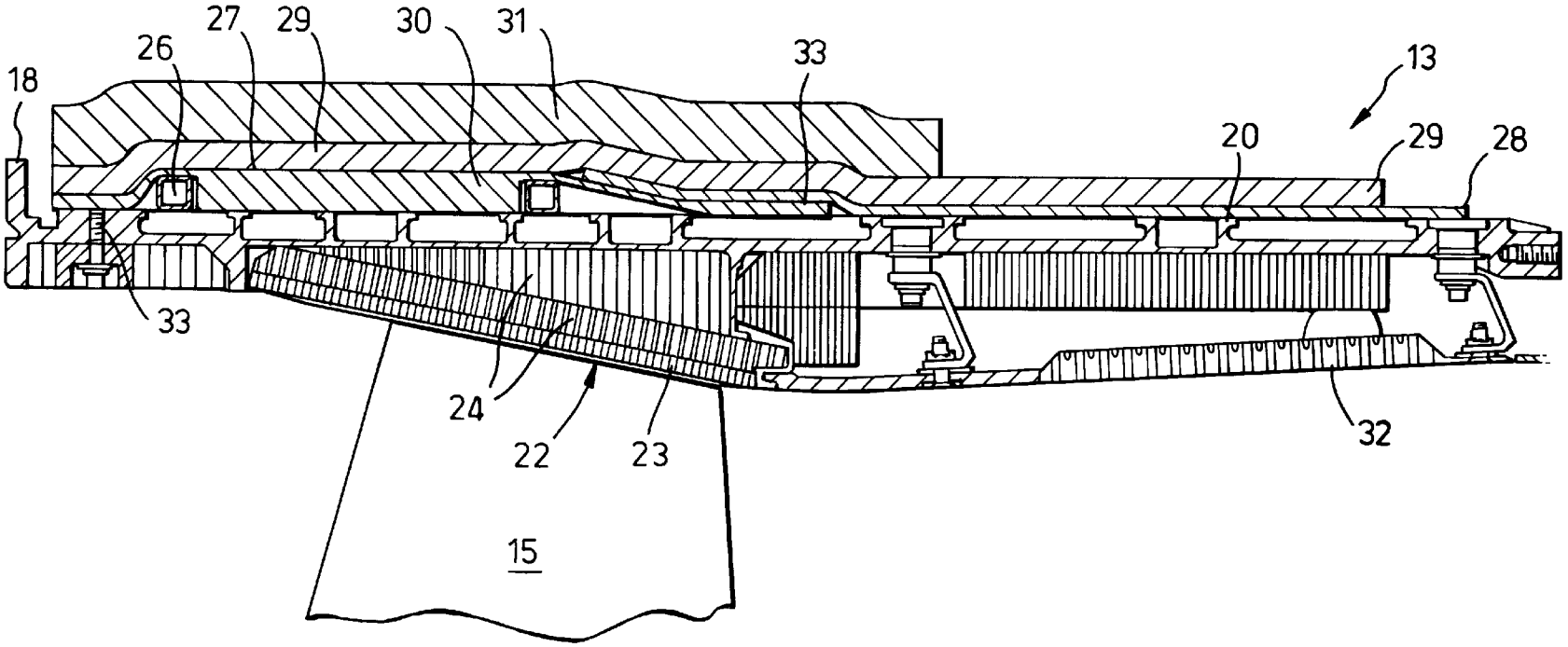
FIG. 2 is a sectioned side view of part of the fan casing of the ducted fan gas turbine engine shown in FIG. 1.

With reference to FIG. 1, a ducted gas turbine engine shown at 10 is of generally conventional configuration. It comprises a core engine 11 which drives a propulsive fan 12 enclosed within a fan casing assembly 13. The exhaust from the fan 12 is divided into two flows. The first and largest flow is directed to the exterior of the engine 10 over an annular array of outlet guides 14 located at the downstream end of the fan casing 13. The outlet guide vanes 14 are generally radially extending and interconnect the fan casing 13 with the core engine 11. The remainder of the air flow from the fan 12 is directed into the core engine 11 where it is compressed and mixed with fuel before being combusted to drive the core engine 11 by conventional turbines.

The fan 12 comprises an annular array of radially extending aerofoil cross section blades 15 mounted on a common hub 16. During the operation of the ducted fan gas turbine engine 10, the core engine 11 drives the fan 12 at high speed. There is a remote chance that as a result of mechanical failure, all or part of one or more of the fan blades 15 could become detached from the remainder of the fan 12. Such mechanical failure could arise, for example, as the result of a foreign body, such as a bird, impacting the fan. The high rotational speed of the fan 12 ensures that any such detached fan blade 15 is flung radially outwards with great force towards the fan casing assembly.

It is extremely important from a safety point of view that the detached fan blade 15 should be contained within the fan casing 13. Thus it should not pass through the fan casing assembly 13 and cause damage to the aircraft upon which the engine 10 is mounted.

The fan casing 13 comprises an annular cross-section casing 13 which is supported from the core engine 11 by means of outlet guide vanes 14. Flange 18 is provided at the upstream end of the casing to facilitate attachment of the casing to the engine intake and outlet guide vanes and to provide stiffening of the casing.

The radially inner surface of the fan casing 17 supports an annular liner 22 which surrounds the radially outer extents of the fan blades 15. The liner 22 protrudes a significant distance radially inwardly so that it terminates immediately adjacent the radially outer tips 23 of the fan blades 15. The liner 22 also supports an annular flow defining structure 31. The majority of the liner 22 is formed from a metallic honeycomb material 24, part of which is axially inclined to follow the profile of the fan blade tips 23. The radially inner surface of the fan blade is, however, provided with a coating of a suitable abradable material. As the fan blades rotate during normal engine operation their tips 23 cut a path through the abradable coating. This ensures that the radial clearance between the liner 22 and the fan blade tips 23 is as small as possible, thereby minimising efficiency damaging air leakage across the blade tips 23.

As well as minimising air leakage across the blade tips 23, the liner 22 performs two further important functions. Firstly it assists in the stiffening of fan casing 17. Clearly any lack of stiffness in the fan casing 17 could result in flexing of the liner 22 and the fan blade tips 23. Secondly, in the event that the whole or part of one of the fan blades 15 should become detached, the honeycomb construction of the liner 22 defines a region which the fan blade 15 or fan blade 15 portion can move into. This tends to minimise the possibly damaging interaction between the detached fan blade and the remaining fan blades 15 thereby causing additional engine damage.

The fan casing 17 is of such a thickness that in the event of a detached blade 15 or fan blade 15 portion coming into contact with it, it is pierced. Thus, although the fan casing 17 alone is not capable of containing a detached fan blade 15 or fan blade portion 15 it does absorb some of the kinetic energy of the blade 15.

Containment of a detached fan blade 15 or fan blade portion 15 is provided by containment material which is provided around the radially inner surface of the fan casing 17. More specifically the portion of the radially outer surface of the fan casing 17 which is radially outwardly of the fan blade tips 23 and slightly upstream thereof, is provided with two annular axially spaced apart frangible rail members 26. The rail members 26 are attached to the fan casing 17 thereby providing additional stiffness of the casing 17.

The axial space between the rails 26 is filled with discrete pieces of flexible material 27 woven from aromatic polyamide fibres known as KEVLAR (KEVLAR is a registered trademark of Dupont Ltd). The pieces 27 are held loosely together by cotton stitching.

A number of continuous layers of KEVLAR are wound at 28 and 29 around the fan casing 17 between the most downstream of the rails 26 and a region upstream of the fan casing flange 19. These layers provide blade containment.

A number of carbon fibre panels 30 are interposed between the fibrous patches and the wound layers of KEVLAR. The panels are positioned over the rails 26 around which the layers of KEVLAR are wound.

In the event that a fan blade 15 or portion becomes detached it pierces the liner 22 and the fan casing 17, before encountering the discrete pieces 27. The pieces 27 which are impacted by the detached fan blade 15 or fan blade portion 15 effectively blunt the sharp edges of the blade 15 by wrapping themselves around the blade.

The blunted detached blade also encounters the rigid panel 30 and detaches the rigid carbon fiber panel 30 from its fixed points 33. The detached panel 30, under the force of the blade, moves into the area of wound KEVLAR. The impact of the moving blade on the KEVLAR is spread over a larger area which helps to minimise the cutting forces of the blade. This also has the advantage that less KEVLAR is required.

Another advantage of the provision of a rigid panel is that if the fan casing itself should develop a circumferential crack due to the force from the impact of a detached blade, the panel or panels will act as a secondary load path. Thus the carbon fibre panel would accommodate the subsequent aerodynamic and inertia forces within the fan and engine mountings.

I claim:

1. A gas turbine casing assembly comprising an annular cross section casing configured to surround an annular array of rotary aerofoil blades, said casing defining a radially outer surface and positioned therewith a plurality of layers of flexible material wound as continuous lengths around said casing wherein at least one substantially rigid panel is interposed between said flexible material and said annular cross section casing; said rigid panel being frangible and detachably mounted on said casing at spaced apart points on said rigid panel.

2. A gas turbine casing assembly as claimed in claim 1 wherein said at least one rigid panel is a carbon fibre panel.

3. A gas turbine assembly as claimed in claim 1 or claim 2 wherein said rigid panel is frangible.

4. A gas turbine engine casing assembly as claimed in claim 1 wherein said at least one rigid panel is fastened to the casing at each end of said panel.

5. A gas turbine engine assembly as claimed in claim 1 wherein said layers of flexible material comprise woven aromatic polyamide fibres.

* * * * *